US009007406B2

(12) United States Patent
Mori

(10) Patent No.: US 9,007,406 B2
(45) Date of Patent: Apr. 14, 2015

(54) DISPLAY CONTROL APPARATUS AND METHOD OF CONTROLLING THE SAME

(75) Inventor: Kurumi Mori, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 164 days.

(21) Appl. No.: 13/198,625

(22) Filed: Aug. 4, 2011

(65) Prior Publication Data

US 2012/0044266 A1 Feb. 23, 2012

(30) Foreign Application Priority Data

Aug. 17, 2010 (JP) ..... 2010-182588

(51) Int. Cl.
*G09G 5/00* (2006.01)
*G09G 5/34* (2006.01)

(52) U.S. Cl.
CPC ..... *G09G 5/34* (2013.01); *G09G 2340/0442* (2013.01); *G09G 2340/0464* (2013.01); *G09G 2354/00* (2013.01)

(58) Field of Classification Search
None
See application file for complete search history.

(56) References Cited

U.S. PATENT DOCUMENTS

| | | | | |
|---|---|---|---|---|
| 7,519,920 | B2 * | 4/2009 | Jarrett et al. | 715/785 |
| 8,106,856 | B2 * | 1/2012 | Matas et al. | 345/73 |
| 2005/0180858 | A1 * | 8/2005 | Halgas, Jr. | 417/53 |
| 2005/0190280 | A1 | 9/2005 | Haas et al. | |
| 2007/0200826 | A1 * | 8/2007 | Zeng et al. | 345/166 |
| 2008/0040692 | A1 * | 2/2008 | Sunday et al. | 715/863 |
| 2008/0052945 | A1 | 3/2008 | Matas et al. | |
| 2008/0222558 | A1 | 9/2008 | Cho et al. | |
| 2010/0107116 | A1 * | 4/2010 | Rieman et al. | 715/784 |
| 2011/0072383 | A1 * | 3/2011 | Olausson et al. | 715/772 |
| 2011/0090255 | A1 * | 4/2011 | Wilson et al. | 345/647 |
| 2011/0119578 | A1 * | 5/2011 | Schwartz | 715/702 |
| 2012/0183273 | A1 * | 7/2012 | Utsuki et al. | 386/230 |

FOREIGN PATENT DOCUMENTS

| | | | |
|---|---|---|---|
| CN | 1335950 | A | 2/2002 |
| CN | 1592364 | A | 3/2005 |
| CN | 101739206 | A | 6/2010 |

(Continued)

OTHER PUBLICATIONS

European Search Report issued on Oct. 31, 2012, that issued in the corresponding European Patent Application No. 11177558.1.

(Continued)

*Primary Examiner* — David H Chu
(74) *Attorney, Agent, or Firm* — Cowan, Liebowitz & Latman, P.C.

(57) ABSTRACT

This invention provides a display control apparatus capable of more quickly displaying the next image while suppressing a decrease in viewability. The apparatus displays an image together with an added non-image area when displaying, in a display area of a display unit to be used to display an image, the image having an aspect ratio different from that of the display area. Upon accepting a scroll operation of instructing scroll display of the image displayed in the display area, the apparatus performs the scroll display in accordance with the scroll operation. At this time, the apparatus adjusts the non-image area to decrease the width of the non-image area in the moving direction of the scroll during execution of the scroll display as the operation amount of the accepted scroll operation increases.

13 Claims, 8 Drawing Sheets

(56) References Cited

FOREIGN PATENT DOCUMENTS

| | | | | |
|---|---|---|---|---|
| JP | 05-100809 | | | 4/1993 |
| JP | 2002-125190 | | | 4/2002 |
| JP | 2002-251241 | A | | 9/2002 |
| JP | 2007-096472 | | | 4/2007 |
| JP | 2009-187057 | A | | 8/2009 |
| JP | 2009187057 | A | * | 8/2009 |
| WO | 2009/149976 | A2 | | 12/2009 |

OTHER PUBLICATIONS

Korean Search Report issued on Sep. 27, 2013, that issued in the corresponding Korean Patent Application No. 10-2011-0079953.

Jan. 27, 2014 Japanese Office Action, that issued in Japanese Patent Application No. 2010-182588.

Oct. 10, 2013 Chinese Office Action, that issued in Chinese Patent Application No. 201110241706.3.

* cited by examiner

DISPLAY CONTROL APPARATUS AND METHOD OF CONTROLLING THE SAME

BACKGROUND OF THE INVENTION

1. Field of the Invention

The present invention relates to a display control apparatus which switches displayed images while scrolling them, and a method of controlling the same.

2. Description of the Related Art

An image reproduction apparatus such as a digital camera is conventionally equipped with a scroll image switching effect to switch from a currently displayed image to the next or previous image by scroll operations in the horizontal or vertical direction upon, for example, reproduction display of representative images of still images or moving images. Additionally, with the advent of user interfaces using a touch panel, a screen switching method for scrolling in accordance with the operation of a finger placed on the screen is becoming popular.

Japanese Patent Laid-Open No. 05-100809 discloses scrolling displayed objects in the moving direction of the finger by setting the finger moving speed as the initial velocity upon determining that the moving amount or moving speed of the finger on the touch panel has exceeded a predetermined value. This document also discloses after the user has moved the finger off the panel, decelerating and stopping the scroll.

Japanese Patent Laid-Open No. 2002-125190 discloses making the image fast-forward instruction key compatible with analog input and changing the fast-forward speed based on the input value. The larger the depression force on the key or the key tilt angle is, the higher the fast-forward speed is. As the fast-forward speed increases, the display size per image to be smooth-scrolled decreases.

On the other hand, if the aspect ratio of an image does not match that of the display area, the image is displayed while making its size coincide with the display area size in one direction. Black bars are displayed horizontally above and below the image (letterbox) or vertically on both sides of the image (pillarbox).

Japanese Patent Laid-Open No. 2007-096472 discloses displaying a black image on the left and right sides of a 16:9 wide liquid crystal display, thereby displaying a 4:3 image.

However, when feeding images at a higher scroll speed by simply increasing the operation speed of single image feed, the following problems arise. That is, especially when scrolling images such as still images in different aspect ratios, non-image areas (in general, pillar box display portions such as black image areas) inserted in the scroll direction need to be scrolled as well. For this reason, even if the user wants to quickly display the next image by speeding up the scroll, scrolling the non-image areas takes time. In addition, if the image size is decreased to speed up image feed, as Japanese Patent Laid-Open No. 2002-125190, or the scroll speed is too high, the viewability of scrolled images lowers.

SUMMARY OF THE INVENTION

The present invention has been made in consideration of the above-described problems, and provides a display control apparatus that is capable of more quickly displaying the next image while suppressing a decrease in viewability upon scrolling.

According to one aspect of the present invention, a display control apparatus comprises a display control unit configured to control to display an image together with an added non-image area when displaying, in a display area of a display unit to be used to display an image, the image having an aspect ratio different from that of the display area, an acceptance unit configured to accept a scroll operation of instructing scroll display of the image displayed in the display area, a scroll control unit configured to control to perform the scroll display in accordance with the scroll operation accepted by the acceptance unit, and an adjustment unit configured to adjust the non-image area to decrease a width of the non-image area in a moving direction of the scroll during execution of the scroll display as an operation amount of the scroll operation accepted by the acceptance unit increases.

Further features of the present invention will become apparent from the following description of exemplary embodiments (with reference to the attached drawings).

DESCRIPTION OF THE EMBODIMENTS

<First Embodiment>

In the first embodiment, an example will be described in which non-image areas between images are adjusted in accordance with the image moving speed (scroll speed).

Figure 1A:
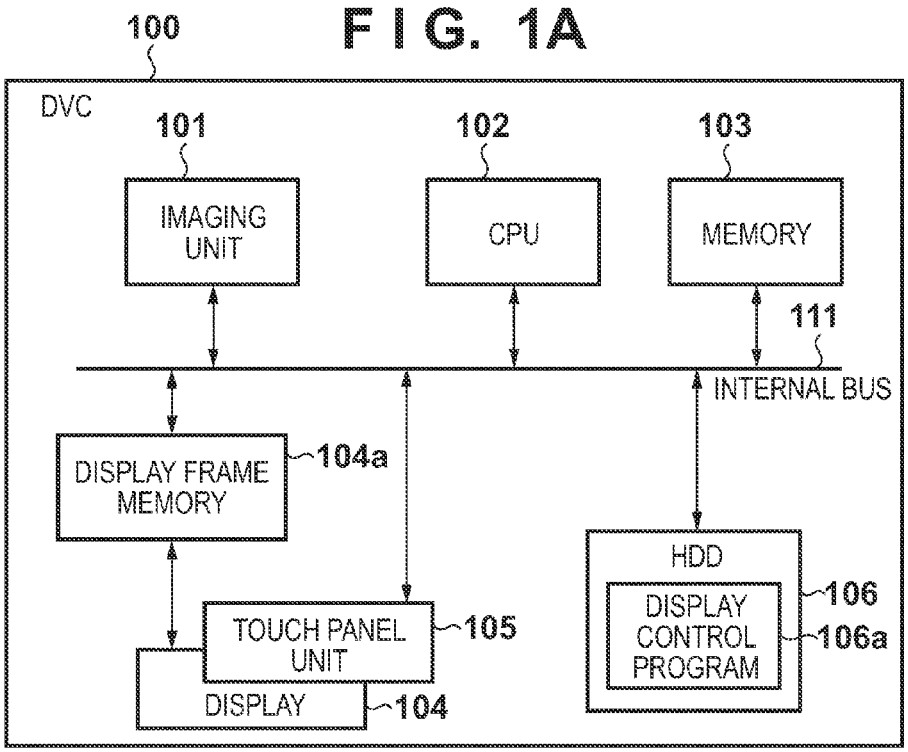
FIGS. 1A and 1B are block diagrams showing examples of the arrangement of a digital video camera according to the embodiments.

FIG. 1A illustrates an example of the arrangement of a digital video camera (DVC) that is an example of a first image recording apparatus in which a display control apparatus of the present invention can be implemented. As shown in FIG. 1A, a DVC 100 includes an imaging unit 101, a CPU 102, a memory 103, a display 104, a touch panel unit 105, and an HDD 106 which are connected via an internal bus 111. The imaging unit 101 receives obtained image information. The CPU 102 is an arithmetic processor configured to record and reproduce image information. The CPU 102 accepts user instructions via the touch panel unit 105 and the like, executes various kinds of processing to be described later, and performs display control of the display 104. The HDD 106 records image information, and stores a display control program 106*a* to implement the display control of the present invention. The memory 103 is used as the work area of the CPU 102. The memory 103 also functions as an image data buffer that buffers image data to be displayed upon receiving an image feed instruction by a user operation. The display 104 serves as a display unit configured to display a graphical user interface (to be referred to as a GUI hereinafter) according to this embodiment. An image to be obtained or a reproduced image is displayed on the display unit. A display frame memory 104*a* renders image data to be displayed on the display 104.

The touch panel unit 105 is integrated with the display 104. For example, the touch panel unit 105 having such a light transmittance that never impedes display on the display 104 is attached on the display screen of the display 104. Input coordinates on the touch panel unit 105 are associated with display coordinates on the display 104. This allows to construct a GUI that makes the user feel as if they are directly operating the screen displayed on the display 104. The CPU 102 can detect the following operations on the touch panel unit 105.

(1) Touching the touch panel unit 105 by a finger or pen (to be referred to as "touch-down" hereinafter).

(2) Keeping a finger or pen in contact with the touch panel unit 105 (to be referred to as "touch-on" hereinafter).

(3) Moving a finger or pen kept in contact with the touch panel unit 105 (to be referred to as "move" hereinafter).

(4) Moving a finger or pen off the touch panel unit 105 (to be referred to as "touch-up" hereinafter).

(5) Nothing in contact with the touch panel unit 105 (to be referred to as "touch-off" hereinafter).

The CPU 102 is notified, via the internal bus 111, of the operations or position coordinates where the finger or pen touches the touch panel unit 105, and determines, based on the received information, the operation performed on the touch panel unit 105. As for move, the moving direction of the finger or pen that moves on the touch panel unit 105 can also be determined for each of the vertical and horizontal components on the touch panel unit 105 based on the change in the position coordinates. A stroke is drawn by performing touch-down, move for a predetermined distance, and touch-up on the touch panel unit 105. An operation of quickly drawing a stroke is called flick. Flick is an operation of quickly moving a finger, for example, on the touch panel unit 105 for a certain distance while keeping them in contact with each other and then directly moving the finger off. In other words, flick is an operation of quickly tracing the touch panel unit 105 like a flip. Upon detecting move for a predetermined distance or more at a predetermined speed or more and then direct touch-up, the CPU can determine that flick has been done. Upon detecting move for a predetermined distance or more at a speed smaller than a predetermined value, the CPU can determine that drag has been done. The touch panel unit 105 can be of any of various types such as a resistive film type, capacitance type, surface acoustic type, infrared type, electromagnetic induction type, image recognition type, and photosensor type.

Figure 2A:
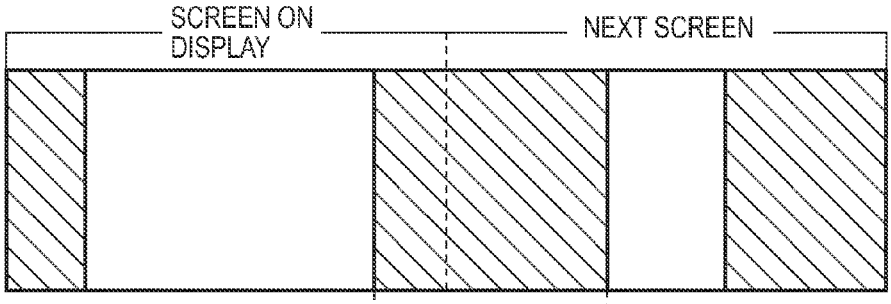
FIGS. 2A to 2D are views for explaining display control during a scroll operation according to the embodiment.

FIG. 2A is a view showing still image display on the display 104. The left half indicates the screen displayed on the display 104. The right half indicates the screen to be displayed upon receiving an image feed instruction by a user operation. The data of this screen is buffered in the memory 103. The hatched areas are non-image areas such as black bars (pillar box). In recent DVCs and digital cameras as well, the display is becoming wider. For example, when a 4:3 image is displayed on the display 104 that is a 16:9 wide monitor, such non-image areas are displayed.

An image is sometimes displayed using a partial area of the display 104. If the aspect ratio of the display area (a partial area of the display 104) to display the image is different from that of the image, the image is displaying by resizing the vertical or horizontal size of the image so as to equal the vertical or horizontal size of the display area. In this display, non-image areas appear in the direction in which the sizes do not match.

In this way, non-image areas are additionally displayed when displaying an image in an aspect ratio different from that of the display area to display the image. In this embodiment, display of the non-image areas is controlled in accordance with an operation of instructing scroll, as will be described below in detail.

Figure 2B:
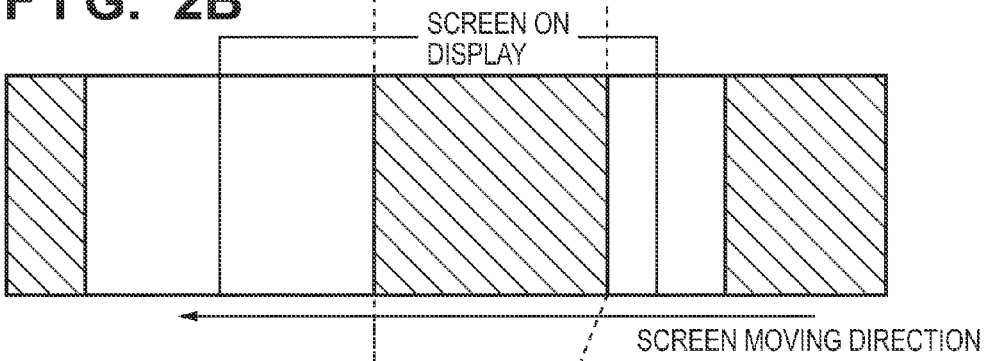

FIG. 2B is a view for explaining the screen during image feed when a predetermined user operation is performed in the still image display state shown in FIG. 2A, and the CPU 102 determines that the operation indicates single image feed. The predetermined user operation is, for example, the above-described flick operation. The flick operation instructs the start of scroll display and the moving direction and speed of the scroll. The CPU 102 accepts the flick operation as a scroll operation. The CPU 102 also controls to perform scroll display in accordance with the accepted scroll operation. Based on one flick operation in this instance, the moving speed of scroll is determined to be that of single image feed. FIG. 2B illustrates an example in which the screen scrolls to left because the flick operation is performed from right to left. "Scroll to left" indicates that scroll is done to move an object (an image or a non-image area) displayed on the display 104 from right to left. When scrolling to left, the undisplayed image arranged on the right side can newly be displayed, and simultaneously, the image displayed so far moves and disappears to left. In this case, the right side will be referred to as upstream, and the left side as downstream. The range of "screen on display" in the drawings indicates the range displayed on the display 104 at a certain point of time during scroll by image feed. In this case, the width of the non-image area (the hatched area in the drawings) in the scroll direction (the horizontal direction of the screen) during feed is the simple sum of the width of the upstream non-image area on the screen before image feed and that of the downstream non-image area on the screen after image feed. Since the scroll amount of single image feed is constant (equal to the scroll-direction width of the display 104) independently of the width of the image before and after image feed, the operation is intuitive and easy for the user.

The user can increase the moving speed of image feed by further performing the flick operation on the moving screen during execution of scroll display. The range of "screen on display" in FIG. 2C indicates the screen displayed on the display 104 during feed at a moving speed increased by further performing the flick operation on the moving screen. The non-image area between the images moves in a width smaller than in FIG. 2B.

Figure 2C:
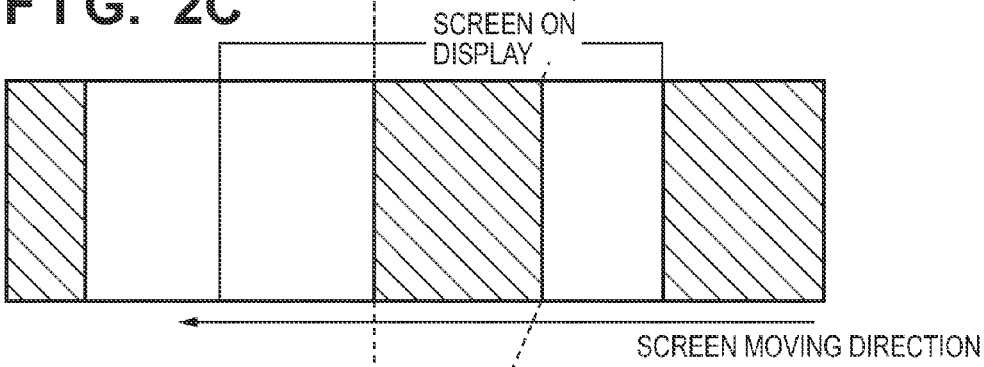
Figure 2D:
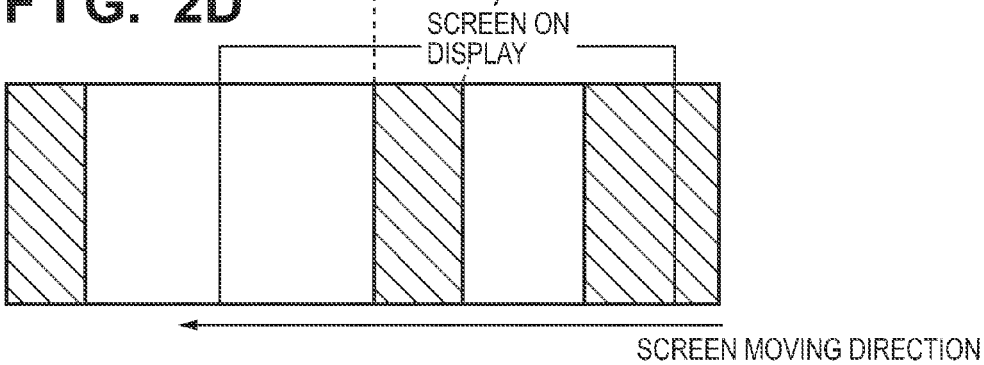

FIG. 2D is a view for explaining the screen displayed during feed at a moving speed increased by further performing the flick operation during the movement in FIG. 2C. The non-image area between the screens is narrower than in FIG. 2C. If the scroll is further accelerated, the speed increases. However, the non-image area is not further reduced and moves while maintaining its width. Even when images without the non-image area continue (so even when subsequent images do not require non-image areas), scroll is done while inserting the non-image area having the width shown in FIG. 2D.

Conversely, when the scroll moving speed is reduced, the non-image area is widened accordingly. As described above, in this embodiment, the image scroll moving speed designated by the user's scroll operation is detected, and the width of the non-image area between images is increased/decreased in accordance with the detected scroll moving speed.

Figure 3:
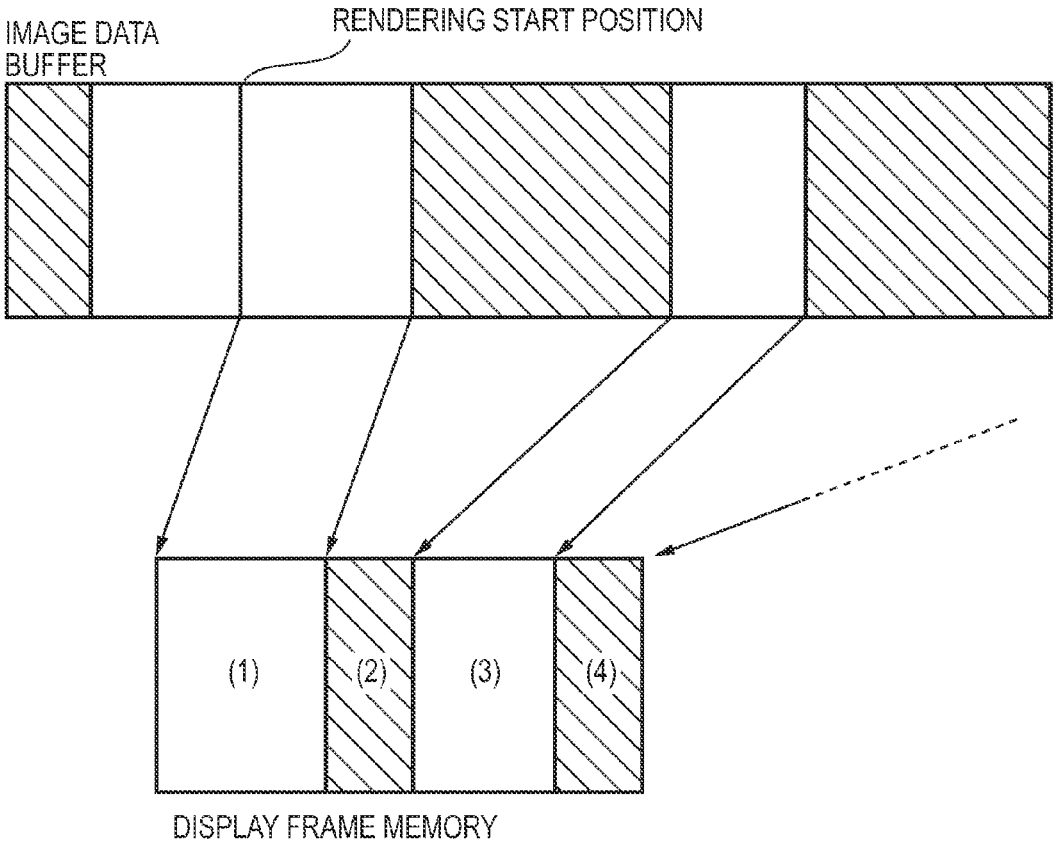
FIG. 3 is a view for explaining write control in a display frame memory when generating one frame to be displayed on the display at a given timing during scroll according to the embodiment.

FIG. 3 shows the order of write control in the display frame memory when generating one frame to be displayed on the display 104 at a given timing during scroll to perform display control shown in FIGS. 2A to 2D. In this embodiment, since rendering starts from the image moving direction (the downstream side of the scroll direction), rendering is performed from the left end in the image moving direction. Since the left end starts not from a non-image area but from an image at this instant, an image portion (1) is rendered first. Next, a non-image area (2) with an adjusted width is rendered. The next image (3) and another non-image area (4) are sequentially rendered while confirming whether the image has been rendered up to the right end of one frame. Such write of one frame in the display frame memory is done while gradually shifting the image display position to express the movement by scroll for each frame rate (frame update rate) of animation processing for implementing scroll display.

Figure 4:
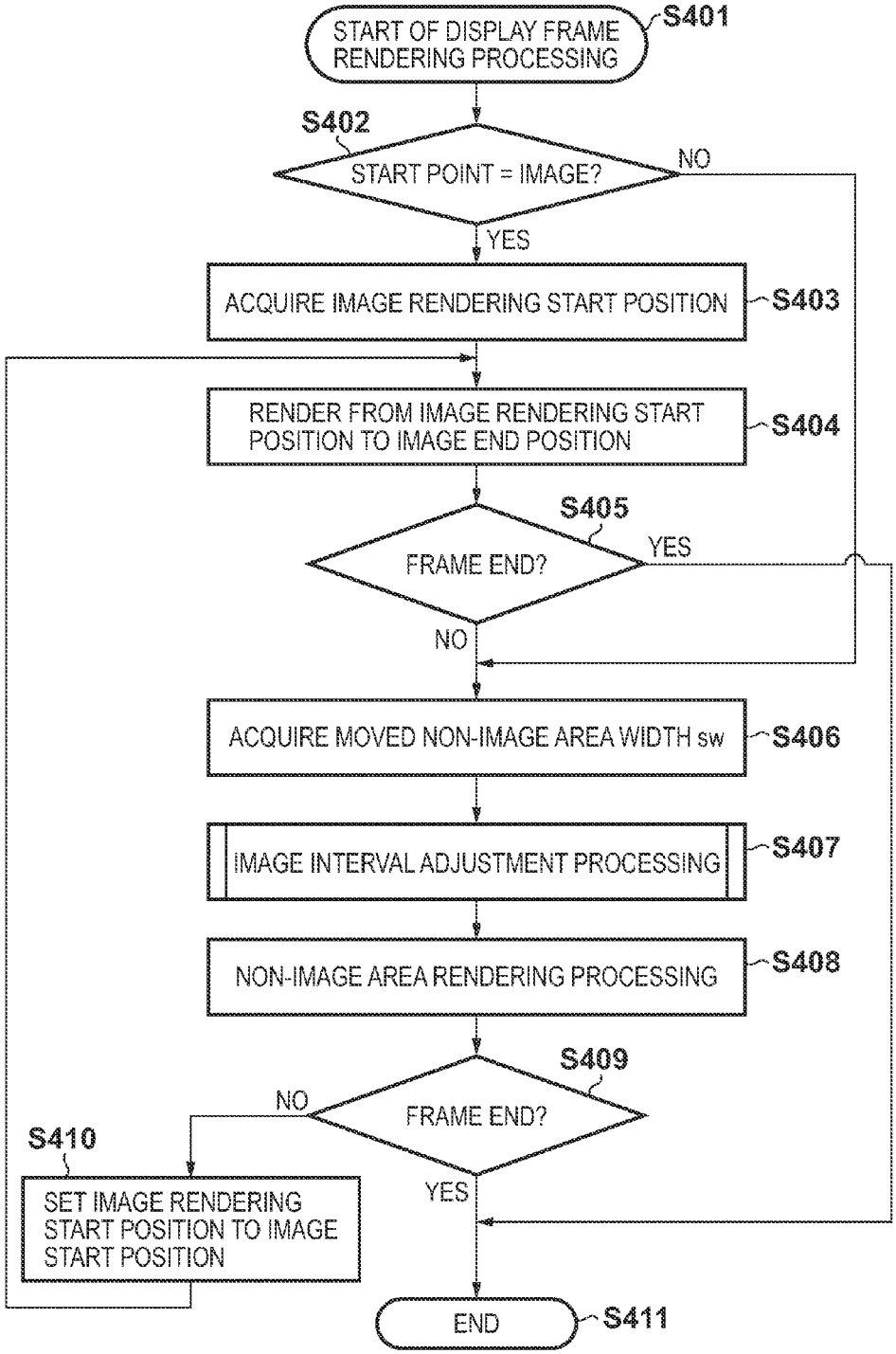
FIG. 4 is a flowchart illustrating processing of rendering one frame on the display frame memory at a given timing during scroll according to the embodiment.

FIG. 4 is a flowchart illustrating processing of rendering one frame on the display frame memory at a given timing during scroll described with reference to FIG. 3. A program corresponding to this flowchart is included in the display control program 106*a*, and for example, loaded in the memory 103 upon powering on the DVC 100 and executed by the CPU 102. Note that storing (writing) data in the display frame memory to enable display on the display 104 will be referred to as "render" in the following description of the flowchart.

When processing starts (S401), the CPU determines whether an image or a non-image area (S402) is the rendering start point (the downstream end of scroll) of one frame at that timing. If the start point is an image, the process advances to step S403. Otherwise, the process advances to step S406.

In step S403, an image rendering start position indicating part of the image to be displayed is acquired. In step S404, a portion of the image to be displayed from the rendering start position acquired in step S403 to the upstream end (image end position) of the image in the scroll direction is rendered on the display frame memory. In a process following step S403, rendering is performed on the display frame memory from the rendering start point. In a process following step S410, the portion already rendered so far on the display frame memory is rendered to the upstream end. When the image has been rendered up to the image end position, or the upstream end of the display frame memory for one frame has been reached during rendering to the image end position, the process advances to step S405.

In step S405, the CPU determines whether the image has been rendered up to the upstream end (frame end) of the display frame memory for one frame (the frame end has been reached). If the frame end has not been reached, the process advances to step S406. The write processing of one frame in the display frame memory ends if the frame end has been reached.

Figure 5:
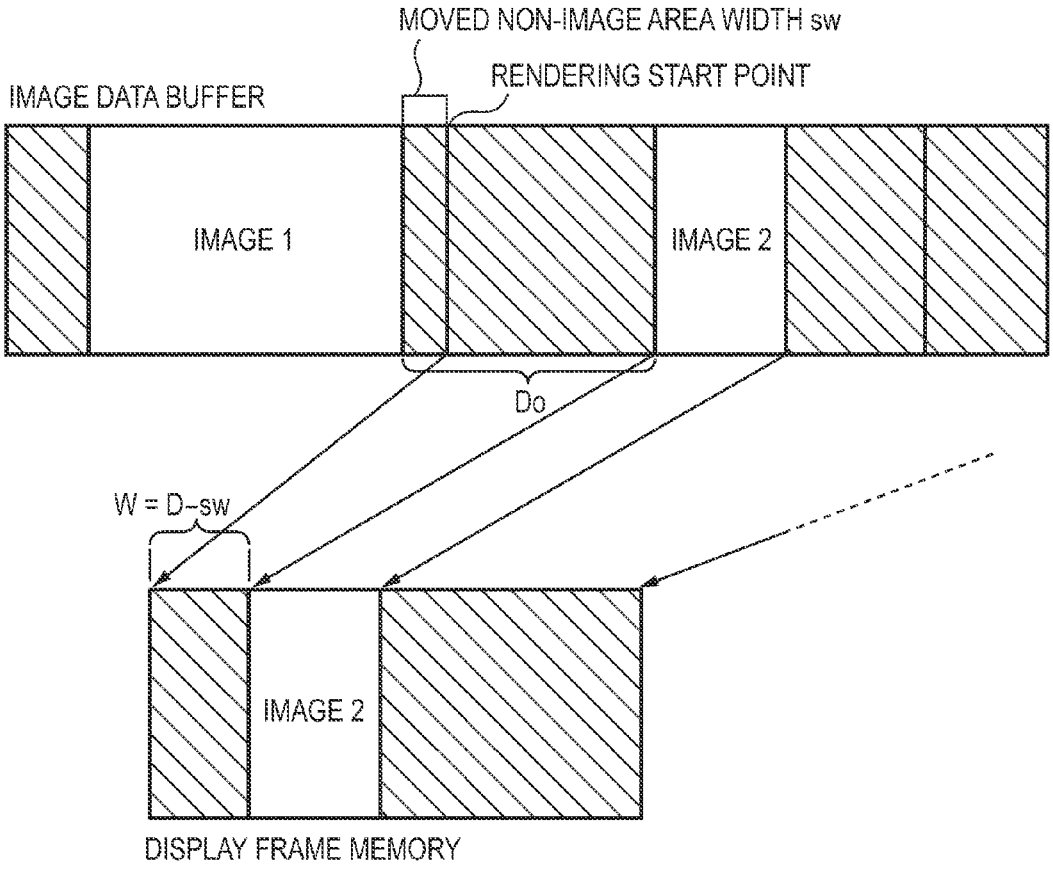
FIG. 5 is a view showing an example of a non-image area according to the embodiment.

In step S406, a moved non-image area width sw is acquired. The moved non-image area width is the width of an already scrolled portion of the non-image area at the rendering start point of the display frame memory. FIG. 5 shows an example of a moved non-image area. In other words, the moved non-image area corresponds to the distance from the upstream end of the image (image 1) that has stopped being the display target immediately before due to scroll to the rendering start point of the display frame memory, as shown in FIG. 5. That is, the moved non-image area width is the scrolled amount from the time the upstream end of the image (image 1) that has stopped being the display target immediately before due to scroll has stopped being the display target to the present time. The moved non-image area width sw is obtained by adding a moving amount x from the preceding display updating to the current display updating to the moved non-image area width sw set for display frame rendering processing in the preceding display updating. Note that if the rendering start point is an image, the moved non-image area width sw is 0.

In step S407, the width of the non-image area in the scroll moving direction is adjusted by image interval adjustment processing. The image interval adjustment processing will be described later in detail with reference to FIG. 6.

In step S408, the non-image area is rendered in the width based on the image interval adjusted by the image interval adjustment processing in step S407. If the portion that is currently being rendered is the portion from the rendering start point of one frame immediately after NO in step S402, the non-image area is only rendered in a rendering width w (to be described later in detail) calculated by the image interval adjustment processing from the rendering start point to the upstream side in the scroll direction. If the portion that is currently being rendered is the portion after image rendering in step S404, the non-image area is only rendered in an image interval D (to be described later in detail) calculated by the image interval adjustment processing from the upstream end of the portion rendered so far to the upstream side. In this case, if the upstream end of the display frame memory for one frame has been reached before rendering the image interval D, the process advances to step S409.

In step S409, the CPU determines whether the image has been rendered up to the upstream end (frame end) of the display frame memory for one frame. If the image has completely been rendered, the one frame has completely been rendered, and the display frame rendering processing ends. Otherwise, the process advances to step S410. In step S410, to display an image to be displayed next to the non-image area, the image rendering start position indicating part of the image to be displayed is set at the downstream end (image start position) of the image to be displayed next in the scroll direction. After that, the process returns to step S404 to repeat the processing until rending on the display frame memory for one frame ends.

The above-described processing shown in FIG. 4 is performed for every frame updating cycle in animation processing for scroll display, thereby implementing the scroll display of the present invention.

Figure 6:
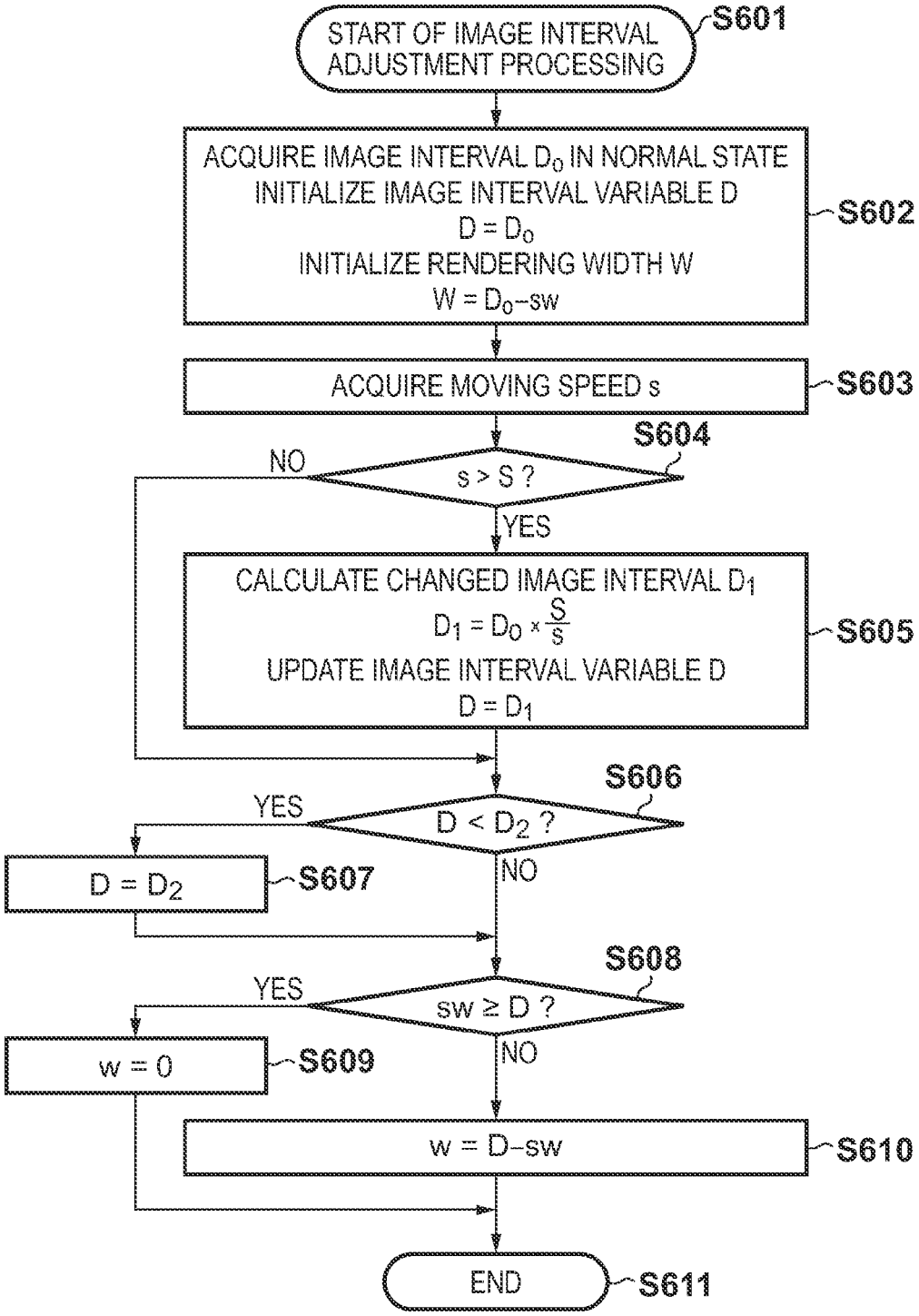
FIG. 6 is a flowchart illustrating image interval adjustment processing according to the first embodiment.

FIG. 6 is a flowchart illustrating details of the image interval adjustment processing in step S407 of FIG. 4. When the image interval adjustment processing starts (S601), an image interval $D_0$ in the normal state is acquired in step S602. The image interval $D_0$ in the normal state indicates the width of the non-image area from the display image to the next image without scroll. That is, when images A and B are arranged adjacently, the image interval $D_0$ is the sum of the width of the non-image area on the side of the image B out of the non-image areas existing on both sides of the image A at rest and the width of the non-image area on the side of the image A out of the non-image areas existing on both sides of the image B at rest (so D0 is the sum of the width of the non-image area on the B-side of image A and the width of the non-image area on the A-side of image B). The image interval $D_0$ in the normal state is set as the initial value of the image interval variable D. The image interval variable is a value that changes depending on the scroll speed decided based on the amount of the user's scroll operation in a process to be described later. The image interval variable decides (is used to determine) the width of the non-image area at the time of scroll. In addition, ($D_0$−sw) is set as the initial value of the variable w (to be referred to as the "rendering width w" hereinafter) indicating the width of the non-image area to be displayed from the rendering start point of the display frame memory to the upstream side in the scroll direction. The value sw represents the moved non-image area width acquired in step S406 of FIG. 4.

Next, a current moving speed s (scroll speed) by scroll is acquired (S603). The CPU determines whether the acquired moving speed s is higher than a predetermined speed S (S604). If the moving speed s is equal to or lower than the predetermined speed S, the process advances to step S606 without updating the image interval variable D. If the moving speed s is higher than the predetermined speed S, the process advances to step S605. In step S605, a changed image interval $D_1$ is calculated, based on the moving speed s decided by the user's scroll operation, so that the changed image interval $D_1$ decreases as the moving speed s increases by, for example, $$D_1=D_0*S/s$$

The image interval variable D is updated to the calculated changed image interval $D_1$.

In step S606, the CPU determines whether the image interval variable D calculated in step S605 is smaller than a predetermined interval $D_2$ ($D_2$ is a predetermined constant) serving as a threshold. If $D<D_2$, the process advances to step S607. Otherwise, the process advances to step S608.

In step S607, the image interval variable D is set (updated) to a fixed width, for example, the predetermined interval $D_2$. This makes it possible to prevent the width of the non-image area displayed between the images from being narrower than the predetermined interval $D_2$ and enables a user to visually recognize the boundary between the images by the non-image area even at a higher scroll speed.

In step S608, the CPU determines whether the moved non-image area width sw is equal to or larger than the image interval variable D. If the moved non-image area width sw is equal to or larger than the image interval variable D, the non-image area existing between the images has already been scrolled. The rendering start point of the display frame memory is not a non-image area but the next image. Hence, the process advances to step S609 to set the rendering width w to zero, and the processing in FIG. 6 ends. On the other hand, if the moved non-image area width sw is not equal to or larger than the image interval variable D in step S608, the process advances to step S610 to set the rendering width w to (D−sw), and the processing in FIG. 6 ends.

According to the above-described first embodiment, the width of the non-image area is adjusted in accordance with the scroll speed, thereby increasing the image feed amount without reducing the image display size. If the scroll speed is the same, the image feed amount can be increased to more quickly display the next image by scrolling using a non-image area adjusted to be narrower as described in the first embodiment than by scrolling without adjusting the non-image area width. That is, it is possible to more quickly display the next image while suppressing a decrease in image viewability. Note that since in this embodiment the scroll speed is decided based on (depends on) the number of user's flick operations, the non-image area width is considered to be adjusted in accordance with the operation amount of the user's flick operations. That is, in the first embodiment, the non-image area is adjusted to be narrower as the operation amount of the user's scroll operations (flick operations in the example of the embodiment) increases.

<Second Embodiment>

In the second embodiment, an example will be described in which the image feed amount is first increased only by adjusting the non-image area between images without increasing the scroll speed non-image area, in accordance with the operation amount of image scroll operations.

Figure 1B:
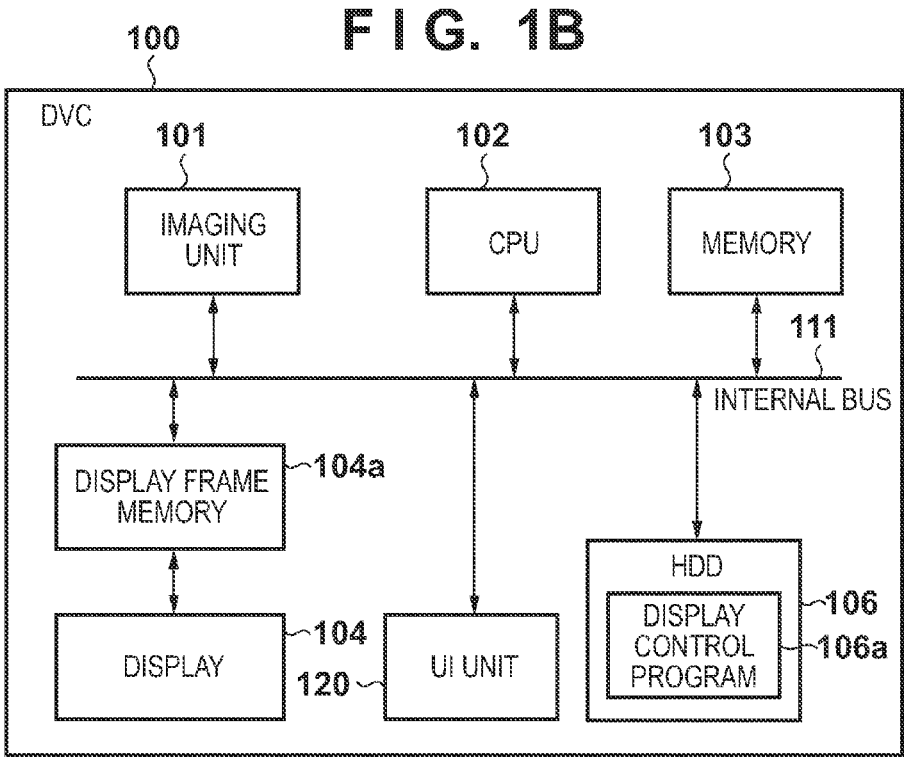

FIG. 1B illustrates an example of the arrangement of a DVC that is an example of a second image recording apparatus in which a display control apparatus of the present invention can be implemented. Unlike FIG. 1A of the first embodiment, the DVC includes a user interface unit 120 (UI unit) including various kinds of keys such as a 4-way selector and a set key in place of the touch panel unit 105. The same reference numerals as in FIG. 1A denote the same constituent elements in FIG. 1B, and a description thereof will not be repeated.

In this embodiment as well, when displaying a still image on a display 104, non-image areas can be displayed on both sides, as shown in FIG. 2A, like the first embodiment. At this time, data of a screen to be displayed upon receiving an image feed instruction by the user operation is buffered in a memory 103, as in the first embodiment.

In this embodiment, for example, when the user operates the right switch of the 4-way selector of the user interface unit 120 once, one image is fed by scroll. The form of the screen at this time is the same as in FIG. 2B. The form of the screen during image feed performed when the user has continuously operated the right switch of the 4-way selector a plurality of number of times is the same as in FIG. 2C. In either case, the scroll speed is assumed to be constant. That is, although the image moving amount (scroll speed) per unit time by scroll is the same, the non-image areas are reduced, thereby shortening the time until the next image is displayed. In other words, the image feed amount is increased in the same time. In addition, when the right switch of the 4-way selector is further operated in the state of FIG. 2C, the non-image area between the images is further reduced, as shown in FIG. 2D, like the first embodiment.

When the right input operation of the 4-way selector is further performed in this screen, the speed increases while holding the width. Even when images without the non-image area continue, scroll moving is done while inserting the non-image area having the width shown in FIG. 2D.

Figure 7:
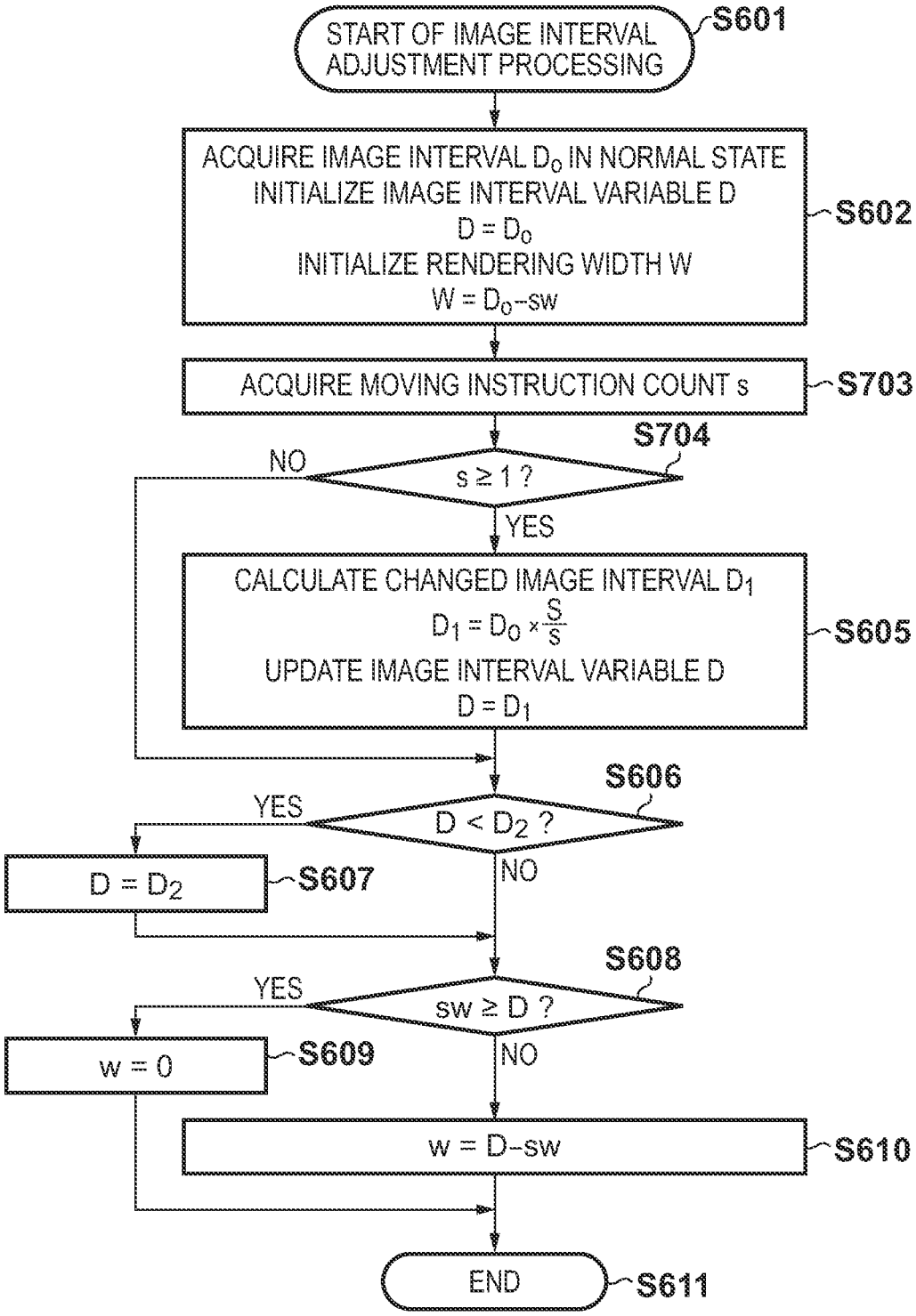
FIG. 7 is a flowchart illustrating image interval adjustment processing according to the second embodiment.

FIG. 7 is a flowchart illustrating image interval adjustment processing according to this embodiment. The procedure of FIG. 7 is almost the same as that of FIG. 6. The same step numbers as in FIG. 6 indicate the same process steps in FIG. 7, and a description thereof will not be repeated. In step S703, a current image feed instruction count s is acquired. In step S704, the CPU determines whether the acquired instruction count s is 1 or more. If the acquired instruction count s is not 1 or more, the image interval variable D remains unchanged. If the acquired instruction count s is 1 or more, the process advances to step S605 to adjust the image interval variable D.

As described above, according to the second embodiment, the width of the non-image area is adjusted in accordance with the image feed operation amount. This makes it possible to effectively increase the feed amount and thus obtain the same effect as in the first embodiment.

<Third Embodiment>

In the third embodiment, an example will be described in which the non-image area between images is adjusted in accordance with the image scroll operation holding time.

The arrangement of a DVC according to this embodiment is the same as that shown in FIG. 1A of the first embodiment. Display control during the scroll operation is done as in FIGS. 2A to 2D of the first embodiment.

Figure 8:
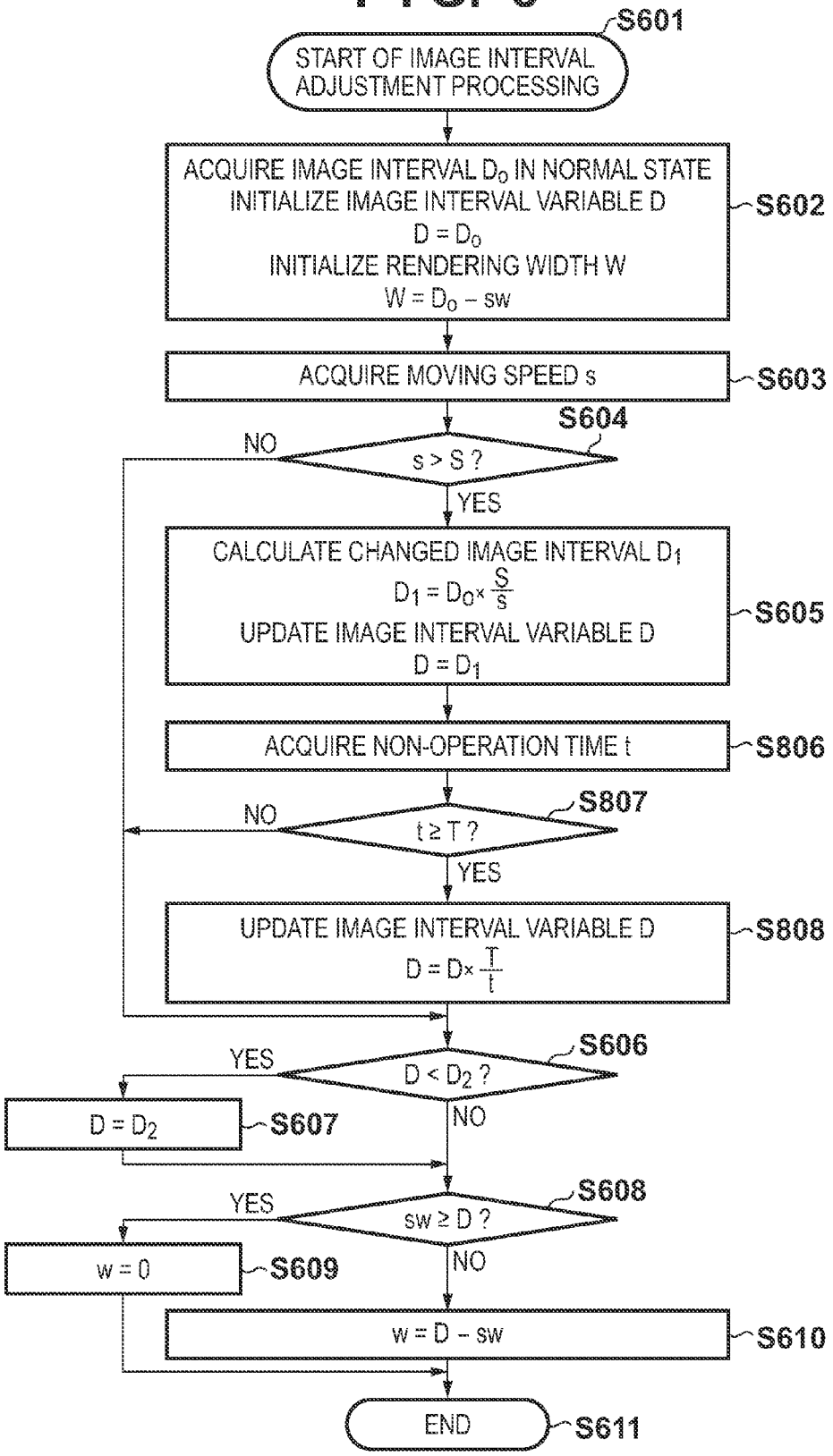
FIG. 8 is a flowchart illustrating image interval adjustment processing according to the third embodiment.

FIG. 8 is a flowchart illustrating image interval adjustment processing according to this embodiment. The same step numbers as in FIG. 6 indicate the same process steps in FIG. 8, and a description thereof will not be repeated.

In this embodiment, after the image interval variable is updated based on the scroll speed in step S605, a non-operation time t on a touch panel unit 105 is acquired (S806). The CPU determines whether the non-operation time t equal to or more than a predetermined time T has elapsed (S807). If the non-operation time t equal to or more than the predetermined time has elapsed, the image interval variable is further updated in accordance with the non-operation time t (S808). A new image interval variable D is calculated by $$D=D*T/t$$

If the non-operation time t is less than the predetermined time T, width adjustment in step S808 is not performed.

According to this embodiment, the width of the non-image area is adjusted in accordance with not only the screen moving speed but also the non-operation time, thereby effectively increasing the feed amount.

Note that the display control processing according to the above-described embodiments can be either executed by one piece of hardware or distributed to a plurality of pieces of hardware.

The present invention has been described above in detail based on its preferred embodiments. However, the present invention is not limited to these specific embodiments and also incorporates various forms without departing from the scope of the invention. The above-described embodiments are merely examples of the present invention and may properly be combined.

In the above-mentioned embodiments, an example in which the scroll speed is increased in accordance with the number of flick operations and an example in which the scroll speed is increased in accordance with the number of operations on the 4-way selector have been explained. However, the present invention is not limited to these examples. For example, the scroll speed can be changed in accordance with the speed of move of the flick operation on the touch panel. An operation member capable of detecting a rotational operation such as a rotary encoder or a touch wheel may be provided. In accordance with the rotational speed of the rotational operation on the operation member, the scroll speed can be increased as the rotational speed increases. Otherwise, a tilt detection unit such as an acceleration sensor may be provided in the display control apparatus main body to change the scroll speed in accordance with the tilt angle of the display device with respect to the direction of gravity.

In the above-mentioned embodiments, an example in which the width of the non-image area (image interval) during scroll is decreased in accordance with the number of flick operations and an example in which the width of the non-image area is decreased in accordance with the number of operations on the 4-way selector have been explained. However, the present invention is not limited to these examples. For example, in accordance with the speed of move of the flick operation on the touch panel (the moving speed of touch), the width of the non-image area (image interval) can be decreased as the speed of move (corresponding to the operation amount) increases. An operation member capable of detecting a rotational operation such as a rotary encoder or a touch wheel may be provided. In accordance with the rotational speed of the rotational operation on the operation member, the width of the non-image area (image interval) can be decreased as the rotational speed increases. Otherwise, a tilt detection unit such as an acceleration sensor may be provided in the display control apparatus main body to adjust the width of the non-image area (image interval) in accordance with the tilt angle of the display device with respect to the direction of gravity.

In the above-mentioned embodiments, an example in which the present invention is applied to a digital video camera has been explained. However, the present invention is not limited to this example. The display control apparatus of the present invention is applicable to various apparatuses capable of simultaneously displaying a plurality of images. The apparatuses include a digital camera, a personal computer, a PDA, a cellular phone terminal, a portable image viewer, a display provided on a printer apparatus to select and confirm a print image, and a digital photo frame.

The above mentioned embodiments have been described with respect to images having non-image portions on both sides of the image (pillarbox) where the scroll direction is horizontal. However, the present invention can also be applied to images having non-image portions above and below the image (letterbox) where the scroll direction is vertical.

<Other Embodiments>

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (for example, computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-182588, filed Aug. 17, 2010, which is hereby incorporated by reference herein in its entirety.

What is claimed is:

1. A display control apparatus comprising:

a display control unit configured to control to display an image together with an added non-image area when displaying, in a display area of a display unit to be used to display an image, the image having an aspect ratio different from that of the display area;

an acceptance unit configured to accept a scroll operation of instructing scroll display of the image displayed in the display area;

a scroll control unit configured to control to perform the scroll display in accordance with the scroll operation accepted by said acceptance unit with no alteration of display size of the image; and an adjustment unit configured to adjust, when an end of images has not been reached, a space between adjacent images displayed on the same display area to decrease a width of the space in a moving direction of the scroll during execution of the scroll display as an operation amount of the scroll operation accepted by said acceptance unit increases, wherein when displaying a first image in a case where the scroll display is not performing, said display control unit controls to display the first image and add the interval without displaying another image, wherein when displaying a second image adjacent to the first image in a case where the scroll display is not performing, said display control unit controls to display the second image and add the interval without displaying another image, wherein in a case where the scroll display is performing, said adjustment unit adjusts the interval between the first and second images so as to become narrower than a sum of the width of the interval on the side of the second image out of the intervals of the first image to be displayed in a case where the scroll display is not performing and the width of the interval of the side of the first image out of the intervals of the second image to be displayed in a case where the scroll display is not performing.

2. The apparatus according to claim 1, wherein said scroll control unit controls to perform the scroll display at a higher scroll speed as the operation amount of the scroll operation accepted by said acceptance unit increases.

3. The apparatus according to claim 1, wherein said scroll control unit performs the scroll display at a predetermined scroll speed if the operation amount of the scroll operation accepted by said acceptance unit is not more than a predetermined threshold, and performs the scroll display at a higher scroll speed as the operation amount increases if the operation amount of the scroll operation accepted by said acceptance unit is more than the predetermined threshold.

4. The apparatus according to claim 1, wherein said adjustment unit performs adjustment to decrease the width as the number of scroll operations serving as the operation amount of the scroll operation increases.

5. The apparatus according to claim 1, wherein said acceptance unit accepts a flick operation on a touch panel as the scroll operation, and said adjustment unit performs adjustment to decrease the width as a moving speed of touch by the flick operation serving as the operation amount of the scroll operation increases.

6. The apparatus according to claim 1, wherein said acceptance unit accepts a rotational operation on an operation member as the scroll operation, and said adjustment unit performs adjustment to decrease the width as a rotational speed by the rotational operation serving as the operation amount of the scroll operation increases.

7. The apparatus according to claim 1, wherein if the operation amount of the scroll operation is more than a predetermined threshold, said adjustment unit sets the width to a fixed width independently of the operation amount of the scroll operation more than the predetermined threshold.

8. The apparatus according to claim 1, wherein if a non-operation time of the scroll operation not less than a predetermined time has elapsed, said adjustment unit further decreases the width in accordance with the non-operation time.

9. A method of controlling a display control apparatus, comprising the steps of:

controlling to display an image together with an added non-image area when displaying, in a display area of a display unit to be used to display one image, the image having an aspect ratio different from that of the display area;

accepting a scroll operation of instructing scroll display of the image displayed in the display area;

controlling to perform the scroll display in accordance with the scroll operation accepted in the accepting step with no alteration of display size of the image; and adjusting, when an end of images has not been reached, a space between adjacent images displayed on the same display area to decrease a width of the space in a moving direction of the scroll during execution of the scroll display as an operation amount of the scroll operation accepted in the accepting step increases, wherein when displaying a first image in a case where the scroll display is not performing, said display control step controls to display the first image and add the interval without displaying another image, wherein when displaying a second image adjacent to the first image in a case where the scroll display is not performing, said display control step controls to display the second image and add the interval without displaying another image, wherein in a case where the scroll display is performing, said adjustment step adjusts the interval between the first and second images so as to become narrower than a sum of the width of the interval on the side of the second image out of the intervals of the first image to be displayed in a case where the scroll display is not performing and the width of the interval of the side of the first image out of the intervals of the second image to be displayed in a case where the scroll display is not performing.

10. A non-transitory computer-readable storage medium storing a program which causes a computer to function as each unit of a display control apparatus of claim 1.

11. The apparatus according to claim 1, wherein said adjustment unit performs adjustment to increase the width as the operation amount of the scroll operation is reduced.

12. The apparatus according to claim 1, wherein said display control unit controls the image to be displayed to resize one direction of the image so as to equal the display area, and to add a non-image area to the resized image in another direction in which the size does not match to the display area.

13. A display control apparatus comprising:

a display control unit configured to control to display an image together with an added non-image area when displaying, in a display area of a display unit to be used to display an image, the image having an aspect ratio different from that of the display area;

an acceptance unit configured to accept a scroll operation of instructing scroll display of the image displayed in the display area;

a scroll control unit configured to control to perform the scroll display in accordance with the scroll operation accepted by said acceptance unit with no alteration of at least display size of the image in a direction perpendicular to a moving direction of the scroll; and an adjustment unit configured to adjust, when an end of images has not been reached, a space between adjacent images displayed on the same display area to decrease a width of the space in a moving direction of the scroll during execution of the scroll display as an operation amount of the scroll operation accepted by said acceptance unit increases, wherein if a non-operation time of the scroll operation not less than a predetermined time has elapsed, said adjustment unit further decreases the width in accordance with the non-operation time.

* * * * *